US005339002A

United States Patent [19]

Braun et al.

[11] Patent Number: 5,339,002

[45] Date of Patent: Aug. 16, 1994

[54] ELECTRIC LAMP AND OPTICALLY ALIGNABLE CEMENTLESS BASE COMBINATION

[75] Inventors: Alfred Braun, Herbrechtingen; Peter Helbig, Sontheim/Br.; Hermann Steiner, Herbrechtingen; Walter Schoenherr, Giengen, all of Fed. Rep. of Germany

[73] Assignee: Patent-Treuhand-Gesellschaft F. Electrische Gluehlampen mbH, Munich, Fed. Rep. of Germany

[21] Appl. No.: 800,997

[22] Filed: Dec. 2, 1991

[30] Foreign Application Priority Data

Dec. 20, 1990 [DE] Fed. Rep. of Germany ... 9017224[U]

[51] Int. Cl.[5] ..... H01K 1/46

[52] U.S. Cl. ..... 313/318

[58] Field of Search ..... 313/318

[56] References Cited

U.S. PATENT DOCUMENTS 4,463,278 7/1984 Kosmatka et al. ..... 313/318
4,492,893 1/1985 Steiner et al. ..... 313/318
5,010,272 4/1991 Eckhardt et al. ..... 313/318

*Primary Examiner*—Sandra L. O'Shea
*Attorney, Agent, or Firm*—Frishauf, Holtz, Goodman & Woodward

[57] ABSTRACT

To permit rapid adjustment of a holder structure (4) within which a single-ended pinch-sealed light source, for example a halogen incandescent lamp (1, 2) is retained, to a positioning or locating element having an optical reference surface (17*a*) to accurately align the light emitting element (2) of the light source with respect to an optical system, for example a reflector, a tubular adjustment sleeve (10) is provided into which the holder structure is fitted. The tubular adjustment sleeve has an essentially cylindrical portion (11) and a slightly conically converging portion (12) or an inwardly extending rim or ring (12') to permit rotational, axial and tilting adjustment of the holder structure to which the light source (1) is coupled with respect thereto. The tubular sleeve is formed with a laterally projecting flange (14, 14*a*) formed with a plane, burr-free engagement surface (14*b*) which fits against an auxiliary plane, flat reference surface (18*b*) on the positioning or locating element (15). The holder structure (4), the adjustment sleeve (10) and the positioning or locating element (15) are all formed of sheet metal and, after appropriately positioning the lamp with respect to the optical reference surface (17*a*) of the holder structure, the metallic elements are welded together, preferably by non-contacting, for example laser welding, to thereby provide for rapid manufacture of accurately aligned light sources with respect to the optical reference surface (17*a*).

24 Claims, 3 Drawing Sheets

ELECTRIC LAMP AND OPTICALLY ALIGNABLE CEMENTLESS BASE COMBINATION

Reference to related patent, the disclosure of which is hereby incorporated by reference: U.S. Pat. No. 4,463,278, Kosmatka et al.

Reference to related patent, assigned to the assignee of the present application, the disclosure of which is hereby incorporated by reference: U.S. Pat. No. 5,010,272, Eckardt et al.

FIELD OF THE INVENTION

The present invention relates to an electric lamp and base combination, in which the lamp is retained in the base without cement, and more particularly to a base which has a reference surface, so that the lamp-base combination can be accurately positioned with respect to an optical element, such as a reflector, and in which the light source on the base can be accurately aligned with respect to the reference surface before the lamp and base are securely joined together. The invention is particularly applicable to replaceable 12 V halogen incandescent lamps, for example of the type H7, having a nominal rating of 55 W, used in headlights of automotive vehicles.

BACKGROUND

Halogen incandescent lamp—reflector combinations require that the light source of the lamp is accurately positioned with respect to the reflector with which it is to be used. Usually, the reflectors are formed with an opening which terminates in a reference surface or plane, against which a corresponding lamp reference surface or plane can be engaged. When the two reference surfaces are in contact, a light source which meets specifications is accurately placed with respect to the reflector. The lamp itself may have two or three terminals, to provide both for high-beam and low-beam energization, with respective filaments or filament portions being located in predetermined positions with respect to the reference surface so that, when the lamp is incorporated in the reflector, the light emitted will be in accordance with predetermined and standardized light distribution patterns, as required by highway safety regulations.

A lamp of this type is described in U.S. Pat. No. 4,463,278, Kosmatka et al. This lamp has a three-element base which includes a metallic holder structure which engages the pinch seal of a halogen incandescent lamp bulb by springy or resilient projections or tongues. The holder extends, in part, within a tubular plastic sleeve. The edge of the sleeve remote from the bulb is seated directly on a plane surface of a bottom portion, likewise of plastic and, before being attached to the bottom portion, can be laterally shifted to provide for optical adjustment with respect to the bottom portion. It can also be rotated.

It has been found that the arrangement is suitable only with plastic bases since, if all-metal or primarily metal bases are used, the substantially thinner walls do not permit the required accuracy of adjustment. The engagement surfaces, due to the thin-walled metal structures, would be insufficiently large. The coupling between the metallic holder and the adjustment sleeve of plastic on the one hand and of the adjustment sleeve on the bottom portion, on the other, require different connecting technologies, one of metal-to-plastic and the other of plastic-to-plastic. The two different connecting technologies cause problems in manufacture, since change-over from one connecting technology to another is complex and time-consuming.

It has been found, in further use, that the freedom of adjustment of the adjustment sleeve with respect to the holder is unduly limited. The sleeve is formed as a straight-tubular element, in which the holder must be accurately fitted in order to obtain, eventually, a good coupling or bonding connection. This requires close tolerances, difficult to achieve with plastic elements and, additionally, does not permit tipping of the holder as an additional freedom of adjustment. Actually, in use, it has been found that the type of holder structure there disclosed did not find commercial acceptance.

The referenced U.S. Pat. No. 5,010,272, Eckhardt et al, describes a combination metal-ceramic holder structure. A metallic holder element can be coupled to a ceramic core element which is essentially immune to high-temperature degradation and provides for excellent insulation and separation of current carrying elements.

THE INVENTION

It is an object to provide a cementless lamp-base combination, in which the lamp can be adjusted with respect to a reference surface on the base, both with respect to rotation, axial shifting, and lateral tipping, which is simple, easy to make, and, once adjusted, permits easy connection of the respective elements of the base and the lamp utilizing only a single connection technology, and which improves the general base construction of the referenced U.S. Pat. No. 5,010,272 Eckhardt et al.

Briefly, a tubular adjustment sleeve retains a lamp holder structure which, in turn, holds the pinch seal of a light source with a light emitting portion which may be the filament of a halogen incandescent light source or the arc of a discharge lamp. The tubular adjustment sleeve, in accordance with a feature of the invention, is formed with a laterally projecting flange which, in turn, engages an auxiliary reference surface on a positioning or locating element acting as the bottom portion which, in turn, is formed with the primary reference surface adapted for engagement with an optical system, for example a reflector. The tubular adjustment sleeve is a sheet-metal element, which is formed with a laterally projecting flange, which flange is in contact with the auxiliary reference surface. Initially, the holder structure of the lamp can be adjusted with respect to the tubular adjustment sleeve both by axial shifting, rotation, as well as tipping or tilting. Once adjusted, the holder and the tubular adjustment sleeve are secured together, preferably by welding and, most suitably, by laser welding; the light source—holder—tubular adjustment sleeve element is then placed against the auxiliary reference surface of the positioning or locating element where, further, it can be adjusted by laterally shifting or rotation and, when in perfect alignment with respect to the auxiliary reference position—the position of which is predetermined with respect to the optical reference surface—the flange and the auxiliary reference surface are connected by the same technology used to secure the holder structure to the tubular adjustment sleeve, that is, preferably by welding, and most suitably by laser welding. All the elements of the holder structure can be made out of metal, preferably thin sheet metal; a ceramic core element can readily be retained within the positioning or locating element as known from the prior art.

The arrangement has the specific advantage that the connection between the respective three components of the base, namely the light source holder structure, the adjustment sleeve, and the position or locating element at the bottom can all be made of sheet metal, so that the connection between the holder element and the adjustment sleeve on the one hand, and between the adjustment sleeve and the positioning or locating element on the other, can be made by using the same technology. In accordance with a particularly preferred feature of the invention, contactless welding is used, and especially laser welding. This has the advantage that it can be carried out rapidly and any previously made adjustment is not changed by the welding operation. Retaining an accurate adjustment of the light source with respect to a reference surface is an important consideration in order to meet the increasing requirement of accuracy of the light pattern emitted from headlights of motor vehicles.

Providing the adjustment sleeve with a flange which projects laterally by 90° from the axis of the sleeve results in a large engagement surface with respect to the auxiliary reference surface of the positioning element. Additionally, the adjustment sleeve can be rotated and, further, laterally shifted with respect to the positioning or locating element, to ensure that the filament of the light source is precisely perpendicular to the plane of the flange and in precisely oriented position with respect to the optical reference surface of the positioning and locating element.

High accuracy can readily be obtained if, in accordance with a feature of the invention, the adjustment sleeve is made in form of a deep-drawn metal part. The adjusting accuracy which can be obtained with the overall base structure of the present invention is substantially better than that of the prior art, in which only the wall of a plastic element forms the engagement surface and the wall thickness must be relied upon to maintain the adjustment. In accordance with a preferred feature of the invention, the flange is accurately made, free from burrs or seams in order to ensure a precisely plain engagement surface with respect to the auxiliary reference surface.

The improved accuracy of adjustment of the light source or, rather, the filament or light emitting region of the light source with respect to the reference surface can be further improved by so making the connection between the holder for the light source and the adjustment sleeve that further optical adjustment between those two elements is possible. In accordance with a feature of the invention, the adjustment sleeve is slightly narrowed at the end region thereof facing the bulb of the light source. This decreases the contacting surface between the adjustment sleeve and the holder element. If this reduction in diameter is formed as a conical contraction, the axially aligned side wall of the holder element engages the adjustment sleeve only along an essentially ring-shaped line contact zone. This permits some tipping of the holder element, and hence of the light source, with respect to the adjustment sleeve. Alternatively, the adjustment sleeve can be formed with an inwardly directed stepped region, to form a slight inwardly constricted ring, having an axial height which is relatively small with respect to the axial length of the adjustment sleeve. Drawing the adjustment sleeve with a slightly conical constriction at the side facing the light source is easier to make; forming the adjustment sleeve with a slightly inwardly stepped ring zone provides for better connection, however, since the engagement surface between the adjustment sleeve and the holder for the light source is slightly larger without, however, interfering with the adjusting movement of the holder element with respect to the sleeve.

As little play as possible should be available between the elements to be connected, in order to ensure a reliable permanent connection, for example by the preferred form of laser welding. In accordance with a preferred feature of the invention, thus, the slightly constricted end portion of the adjustment sleeve can be given some resiliency by forming axial cuts therein. When the holder element with the light source is fitted into the adjustment sleeve, by pushing the holder from the flange side of the adjustment sleeve thereinto, the slightly constricted end, with the cuts formed therein, exactly matches the outer diameter of the holder due to the spring or resilient action of the segments formed by the cut, and retains the holder reliably until the weld connection is made, while still permitting adjustment before the weld is actually effected.

Preferably, the adjustment sleeve is made of sheet metal which is thinner than 1 mm in thickness and, particularly desirably, especially to permit manufacture by deep-drawing and formation of welds, especially laser welds, a wall thickness of from between 0.2 mm to about 0.4 mm has been found desirable.

The width of the engagement surface of the adjustment sleeve on the auxiliary reference surface is now no longer determined by the wall thickness of the adjustment sleeve but, rather, by the lateral projection of the flange. This permits forming the width of the engagement surface with an optimum value, which may be between about 5 to 20 times the wall thickness of the sheet metal used for the adjustment sleeve. This value, of course, is markedly greater than that in which the adjustment sleeve is made of plastic.

The best matching between the flange of the adjustment sleeve and the positioning or locating element is obtained if the diameter of the positioning or locating element is about 20% greater than the outer diameter of the flange.

DRAWINGS

Figure 3A:
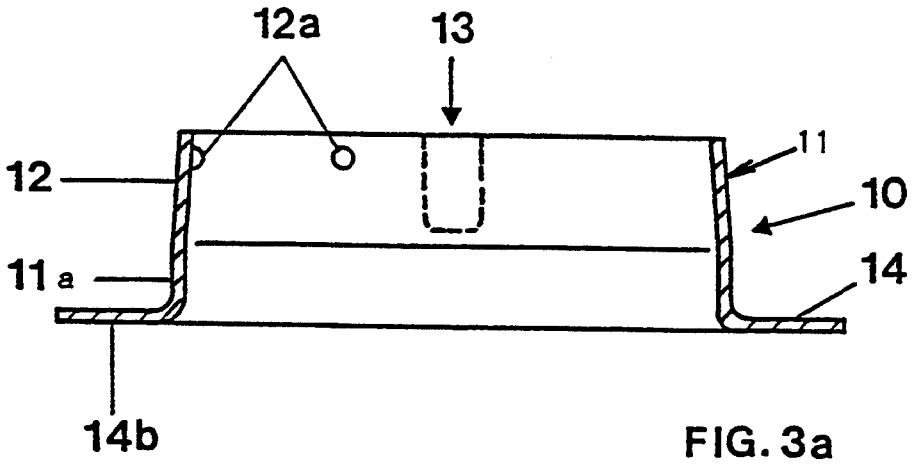
Figure 3B:
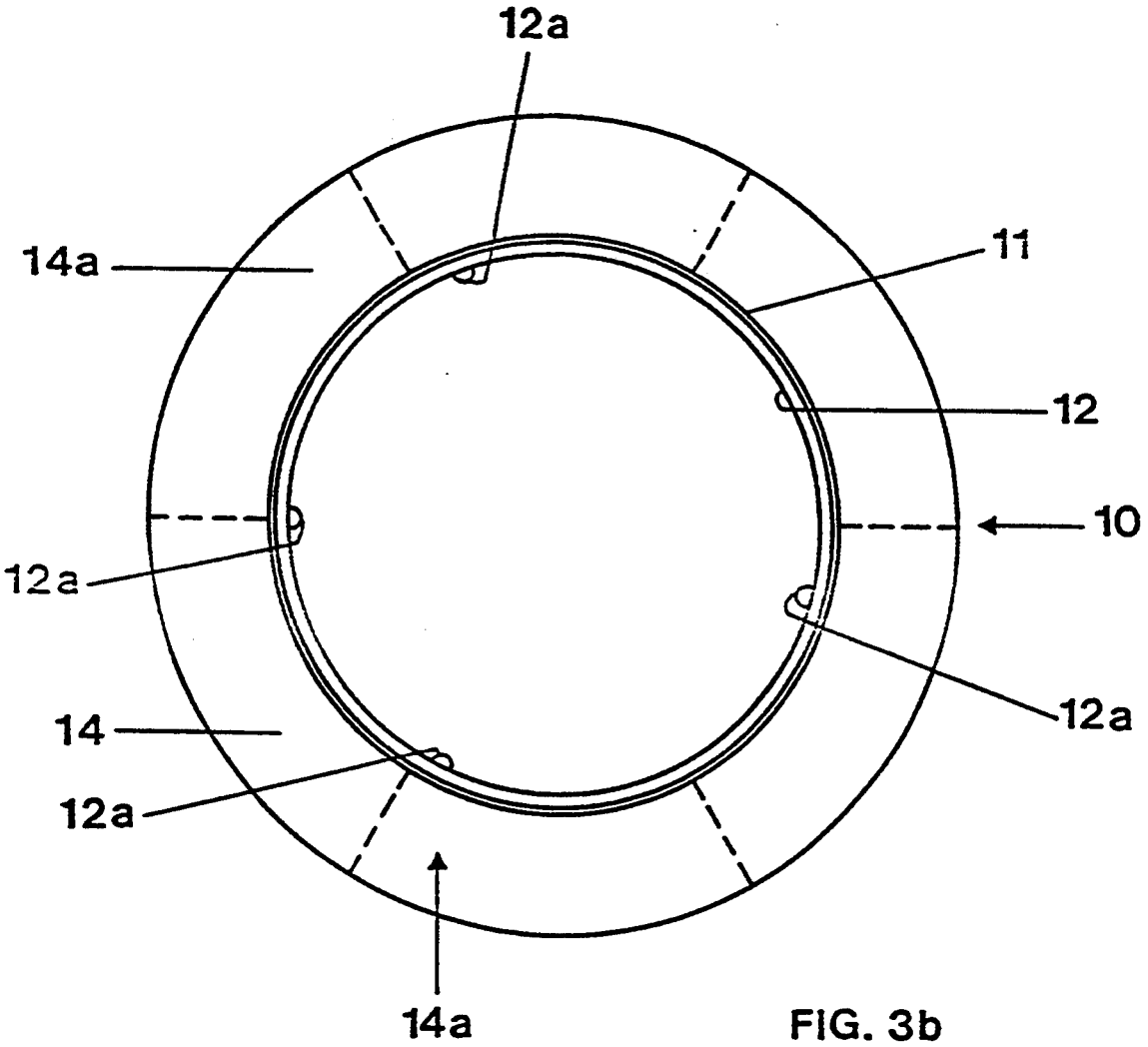

FIG. 3*a* is a vertical sectional view through one embodiment of the adjustment sleeve of the lamp-base combination of the present invention;

FIG. 3*b* is a top view of the adjustment sleeve of FIG. 3*a;*

Figure 4:
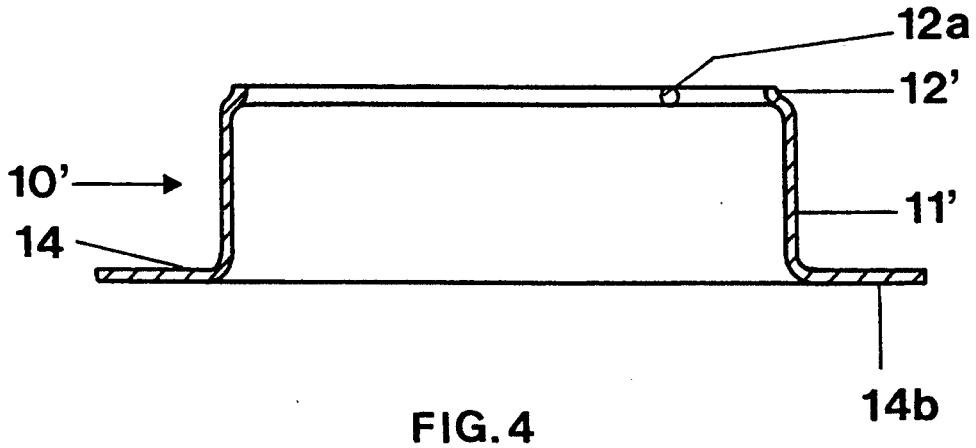
Figure 5:
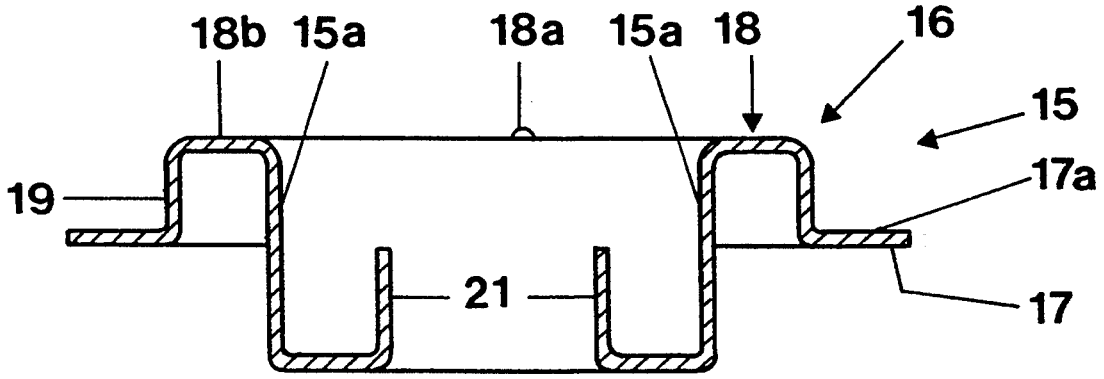

FIG. 4 is a vertical sectional view of another embodiment of the adjustment sleeve; and FIG. 5 is a vertical sectional view of the positioning or locating element of the lamp-base combination.

DETAILED DESCRIPTION

Figure 1:
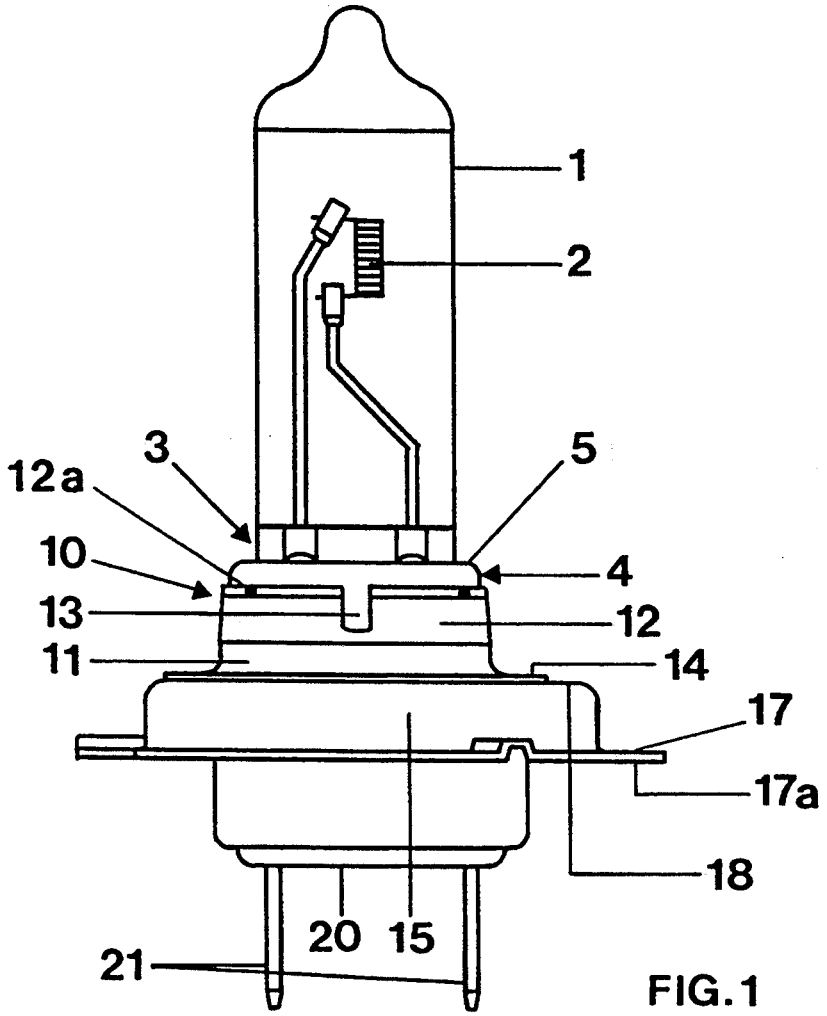
FIG. 1 is a side view of a halogen incandescent lamp for an automotive headlight, in combination with the base in accordance with the present invention.

Referring first to FIG. 1, which illustrates, schematically, a 12 V halogen incandescent lamp of 55 W rating power, and of the standard type H7. It can be used in a high-beam or low-beam headlight for an automotive vehicle. Lamps of this type are described in the referenced U.S. Pat. No. 5,010,272, Eckhardt et al, and especially in FIGS. 7 and 8 thereof, when read in conjunction with the description.

The halogen incandescent lamp 1 has an axially extending light emitting portion which is shown as a filament 2. The bulb of the lamp 1 is pinch-sealed at one end to form an essentially flat, in cross section generally rectangular pinch or press seal. The pinch or press seal 3 is held in a cup-shaped holder 4—see FIG. 2. The holder 4 is made of a copper alloy having a wall thickness of 0.4 mm, and, as well known, resiliently retains the pinch seal. The holder 4 has a wall 5 extending transversely to the filament axis, formed with a slit 6 to receive the pinch seal, a plurality of engagement or locating bumps 7, forming abutments for the lamp bulb, and inwardly extending tabs 8, which resiliently engage the pinch seal. The side wall 9 of the cup-shaped holder 4 is essentially sleeve-like or ring-like, with an axial height of about 4 mm, and an outer diameter of about 14.5 mm.

In accordance with a feature of the present invention, a metallic adjustment sleeve 10, for example made of high-quality steel, receives the holder element 4 with the open side of the cup-shaped element facing downwardly. The adjustment sleeve 10 extends to about half the axial height of the metallic holder 4. It is welded thereto, for example by laser welding. The adjustment sleeve 10, see FIGS. 3*a* and 3*b*, has a cylindrical sleeve or tubular portion 11 having a wall thickness of about 0.3 mm. The lower, straight cylindrical portion 11*a* has an axial height of about 2 mm, and an inner diameter of 15.0 mm. A conically constricting tubular portion 12 is joined to the cylindrical lower wall portion 11*a*. The smallest inner diameter of the conical portion 12 is 14.6 mm. Its axial height is about 3 mm, so that the overall axial height of the adjustment sleeve 10 will be about 5 mm. The dimensions of the conical section, as well as of the holder element 4, can be maintained to close tolerances. If, by working with great care and, therefore, at high costs, the tolerances can be maintained, no auxiliary adjustment arrangements to compensate for tolerances will be necessary.

An easier way is to provide the adjustment sleeve, in accordance with a feature of the invention, with four longitudinal cuts 13 which can be formed within the conical portion 12 of the adjustment sleeve. Since this is not absolutely necessary, the cuts 13 are only shown in broken lines in FIG. 3*a*. The width of the cuts is about 1.5 mm and they extend to a depth of about 2.5 mm and provide a resilient or springy effect to the portion 12 which decreases the requirement for close tolerances. The inner diameter of 14.6 mm then should be considered the upper tolerance limit.

The holder element 4 is coupled to the adjustment sleeve 10 by, for example, four weld points 12*a*, located uniformly circumferentially around the edge of the conical portion 12, as schematically shown in FIG. 3*b*; only one such weld point is shown in FIG. 3*a*, for ease of illustration.

In accordance with a feature of the invention, the adjustment sleeve 10 is formed with a preferably entirely circumferentially extending flange 14, projecting laterally at an angle of 90° from the axis of the adjustment sleeve 10. The flange 14 can be circumferentially uniform, that is, a single piece, or may be formed of a plurality of segments 14*a*; since this is not a necessary feature, the segmentation of the segments 14*a* is shown in broken lines. The outer diameter of the flange 14, or of the flange segments 14*a*, respectively, is 22 mm. The bottom side or surface 14*b* of the flange 14 is flat to within 0.01 mm or less to maintain the accuracy of location of the light emitting portion, here the filament 2, of the light source.

In accordance with another embodiment of the invention, see FIG. 4, the adjustment sleeve 10' has a cylindrical portion 11' of about 4 mm axial length. An inwardly stepped rim or ridge 12', of approximately 1 mm height, then extends from the sleeve portion 11'. The inwardly extending stepped ring 12' has an axial height of about 1 mm, and is formed with a uniform inner diameter of 14.6 mm. Four weld points 12*a*, of which only one is shown in FIG. 4 for simplicity, are uniformly distributed about the step or rim 12'.

In accordance with a further feature of the invention, a metallic positioning or locating bottom element 15 (FIG. 5) has an optical reference surface 17*a* and an auxiliary reference surface 18. The element 15 has the general shape of an axially directed hollow cylinder, having cylindrical walls 15*a*, on which, at the side facing the bulb 1, a collar 16 is formed, bent backwardly about half the height of the element 15, and terminating in an adjustment ring or flange 17, laterally projecting from the element 15. The collar 16 forms a circumferentially extending ring 18 which is coupled to the flange 17 by an axially extending sleeve-like side wall 19. A ceramic base core 20 (FIG. 1) is located and secured within the element 15, in which connecting elements 21, such as lugs or tabs, are retained. The structure as well as the arrangement of current supply leads of the base core are known, and a detailed description thereof is found in the referenced U.S. Pat. No. 5,010,272. The upwardly bent tabs or ring elements 21, extending inwardly and upwardly from the sleeve wall 15*a* of the element 15 can engage in suitable recesses of the ceramic base core 20 to retain the base core in position.

In accordance with a feature of the invention, the ring surface 18 forms an auxiliary engagement or reference surface 18*b* for the lower surface 14*b* of the flange 14. The lower surface 14*b* thus is a counter or reference surface for the auxiliary engagement or reference surface 18*b* on ring 18. The outer diameter of the ring 18 is about 26 mm, its inner diameter about 15 mm. The upper surface 18*b* of the ring 18 is made plane or flat to a tolerance of 0.010 mm. After adjustment, the flange of the sleeve element 10 is connected to the ring 18 by weld points, for example four weld points, of which only one is shown at 18*a*, for simplicity of the drawing. The particular construction of the positioning and locating bottom element 15 is selected to provide for ease of accessibility of the weld points 18*a*.

Lamp Alignment and Assembly

Figure 2:
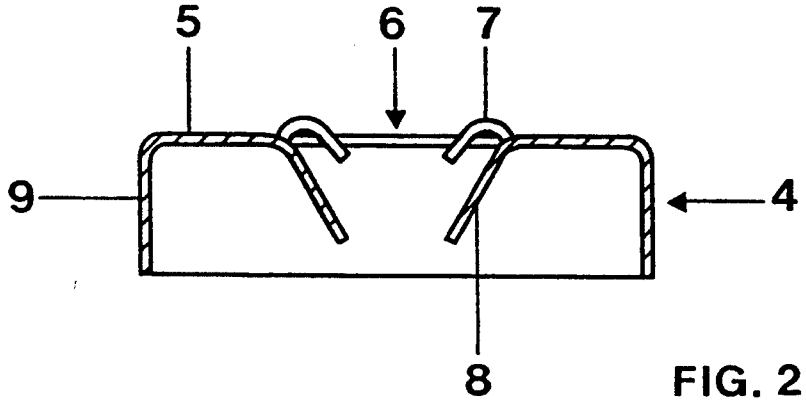
FIG. 2 is a vertical sectional view through the holder structure for the light source as such.

First, the lamp 1 is fitted into the holder element 4 by pushing it therein from the upper side (FIG. 2). This subassembly is then introduced into the adjustment sleeve 10, 10' from the side of the flange 14. A preliminary adjustment then is made to precisely align the filament 2 of the lamp 1 with respect to the reference surface 14*b*. The holder 4 has freedom of adjustment about all three axes in space, that is, it can be tipped, axially shifted, as well as rotated with respect to the adjustment sleeve 10, 10'. When the light emitting portion 2 of the bulb 1 is precisely aligned with the reference surface 14*b* on flange 14, the holder 4 and the sleeve element 10 are welded together by welding at the welding points or spots 12*a*. Laser welding is preferred, since it is non-contacting. Other types of attachment can be used, such as resistance welding, brazing, soldering or the like.

The thus formed second subassembly is seated on the positioning or locating bottom element 15. It can be rotated and/or shifted laterally until the light emitting region, here the filament 2, is at the predetermined position with respect to the reference surface 17*a* on the flange 17. This surface, for example, can fit against a corresponding reference surface of a reflector (not shown). This is a final precision adjustment, in which the longitudinal shifting as well as lateral shifting permits compensation for tolerances of at most 0.1 mm.

The final structure will be a lamp—base unit having a light emitting portion, e.g. a filament 2, which is precise with respect to the reference ring 17, and especially the reference surface 17*a*, and aligned with respect thereto with highest precision.

Various changes and modifications may be made, and the invention is not restricted to the precise embodiments shown. For example, different features can be combined with each other, and the reference surface 17*a* as well as the auxiliary reference surface 18*b* could be coplanar, although the weld points 18*a* may then be difficult to reach. Another modification may be to form the conical portion 12 (FIG. 3) at the end of the adjustment sleeve 10 facing the bulb additionally with an inwardly directed rim or ring similar to the stepped ring 12 (FIG. 4).

The invention is suitable with all lamps in which a light source, and particularly an axially extending filament, has to be precisely adjusted with respect to a reference surface, such as reference surface 17*a* on the flange 17, in which the flange 17 has to be aligned with respect to an optical system, for example fitted into an axial opening within a reflector.

Various other changes and modifications may be made and any features described herein may be used with any of the others, within the scope of the present invention.

We claim:

1. An electrical lamp having a light source (1) defining a lamp axis, including a light emitting element (2);

an optically alignable cementless base (4, 10, 15, 20) retaining said light source, said base including a metallic holder structure (4) coupled to the light source (1);

an at least part-metallic positioning or locating element (15) having an optical reference surface (17*a*) and a plane, flat auxiliary reference surface (18*b*);

a metallic tubular adjustment sleeve (10) surrounding the holder structure, at least in part, said holder structure being axially adjustable in said adjustment sleeve (10) to permit adjustment of said light source (1) with respect to said adjustment sleeve, and subsequent attachment, after adjustment, of the holder structure (4) to said sleeve (10), and wherein said tubular adjustment sleeve (10) comprises a sheet-metal element, which sheet-metal element is formed with a laterally projecting flange (14, 14*a*), said flange having a counter reference surface (14*b*) which is in surface contact with said plane, flat auxiliary reference surface (18*b*), said adjustment sleeve being positioned with said counter reference surface (14*b*) on said auxiliary reference (18*b*) to be rotatable and laterally shiftable with respect thereto to permit additional adjustment of said light source (1) with respect to the positioning or locating element (15) and its optical reference surface (17*a*);

wherein, after adjustment of the light source (1) with respect to the positioning or locating element (15), said tubular sheet-metal adjustment sleeve (10) and said positioning or locating element (15) are secured together by a metal-to-metal connection; and wherein the lateral dimension of the projecting flange (14, 14*a*) is between 5 to 20 times the wall thickness of the adjustment sleeve;

said auxiliary reference surface (18*b*) is a circular ring having an outer diameter which is about 20% larger than the diameter of said projecting flange (14, 14*a*); and wherein said counter reference surface (14*b*) on said flange (14, 14*a*) is devoid of burrs or seams.

2. The lamp of claim 1, wherein the flange (14) comprises a plurality of at least three circular segments (14*a*).

3. The lamp of claim 1, wherein said flange (14) comprises a complete circular flange region.

4. The lamp of claim 1, wherein said positioning or locating element (15) is at least a part-metallic element, and said auxiliary reference surface 18*b* is formed by at least a portion of said part-metallic element; and wherein said metal-to-metal connection comprises a weld connection between said flange (14) and the portion defining said auxiliary reference surface (18*b*).

5. The lamp of claim 1, wherein said holder structure (4) and said tubular adjustment sleeve (10) are connected together by a metal-to-metal connection;

and wherein the metal-to-metal connection of said holder structure (4) to said tubular adjustment sleeve (10) as well as the metal-to-metal connection of said tubular adjustment sleeve (10) and said positioning or connecting element (16) utilize the same metal-to-metal connecting technology, and optionally laser welding.

6. The lamp of claim 1, wherein said positioning or locating element (15) comprises a tubular structure formed with a laterally projecting rim (17) on which said optical reference surface (17*a*) is formed, and said structure further includes a raised ring (18) located, with respect to the light source, above said projecting rim (17), the upper side of said ring (18) being formed with said auxiliary plane reference surface (18*b*) to locate said auxiliary reference surface (18*b*) and said projecting rim (17) at different axial levels to facilitate making said metal-to-metal connection between the counter reference surface (14*b*) of the projecting flange (14, 14*a*) of said adjustment sleeve and said positioning or locating element (15) at said auxiliary reference surface (18).

7. The lamp of claim 1, wherein said adjustment sleeve (10) is formed with a tubular portion (12, 12') at the axial end facing said light source (1) which has a diameter reduced with respect to the diameter of the remainder (11*a*) of said adjustment sleeve.

8. The lamp of claim 7, wherein said laterally projecting flange (14, 14*a*) of the tubular adjustment sleeve (10) is formed with a counter reference surface (14*b*) which is in surface contact with said plane, flat auxiliary reference surface (18*b*); and axially extending cuts (13) are formed in said tubular portion (12) to provide for resiliency thereof.

9. An electrical lamp having a light source (1) defining a lamp axis, including a light emitting element (2);

an optically alignable cementless base (4, 10, 15, 20) retaining said light source, said base including a metallic holder structure (4) coupled to the light source (1);

an at least part-metallic positioning or locating element (15) having an optical reference surface (17*a*) and a plane, flat auxiliary reference surface (18*b*);

a metallic tubular adjustment sleeve (10) surrounding the holder structure, at least in part, said holder structure being axially adjustable in said adjustment sleeve (10) to permit adjustment of said light source (1) with respect to said adjustment sleeve, and subsequent attachment, after adjustment, of the holder structure (4) to said sleeve (10), and wherein said tubular adjustment sleeve (10) comprises a sheet-metal element and said sheet-metal element is formed with a laterally projecting flange (14, 14*a*), said flange being in surface contact with said plane, flat auxiliary reference surface (18*b*), said adjustment sleeve (10) being positioned on said auxiliary reference surface (18*b*) to be rotatable and laterally shiftable with respect thereto to permit additional adjustment of said light source (1) with respect to the positioning or locating element (15) and its optical reference surface (17*a*);

wherein, after adjustment of the light source (1) with respect to the positioning or locating element (15), said tubular sheet-metal adjustment sleeve (10) and said positioning or locating element (15) are secured together by a metal-to-metal connection; and wherein said adjustment sleeve (10) is formed with a tubular portion (12, 12') at the axial end facing said light source (1) which has a diameter reduced with respect to the diameter of the remainder (11*a*) of said adjustment sleeve.

10. The lamp of claim 9, wherein said reduced portion comprises a conically constricting portion.

11. The lamp of claim 9, wherein said reduced portion comprises an inwardly directed step or rim or ring (12').

12. The lamp of claim 9, wherein said holder structure (4) comprises a cup-shaped element having an essentially cylindrical, ring-shaped side wall (9), and wherein the outer diameter of said side wall (9) is matched to fit snugly within the smallest diameter of said reduced portion (12, 12').

13. The lamp of claim 9, including essentially axially extending cuts (13) formed in the tubular portion (12) of the adjustment sleeve (10) which has the reduced diameter to provide for resiliency of said portion.

14. The lamp of claim 9, wherein said laterally projecting flange (14, 14*a*) of the tubular adjustment sleeve (10) is formed with a counter reference surface (14*b*) which is in surface contact with said plane, flat auxiliary reference surface (18*b*).

15. The lamp of claim 9, wherein said counter reference surface (14*b*) of the flange (14, 14*a*) is devoid of burrs or seams.

16. The lamp of claim 9, wherein said positioning or locating element (15) comprises a tubular structure formed with a laterally projecting rim (17) on which said optical reference surface (17*a*) is formed, and said structure further includes a raised ring (18) located, with respect to the light source, above said projecting rim (17), the upper side of said ring (18) being formed with said auxiliary plane reference surface (18*b*) to locate said auxiliary reference surface (18*b*) and said projecting rim (17) at different axial levels to facilitate making said metal-to-metal connection between the counter reference surface (14*b*) of the projecting flange (14, 14*a*) of said adjustment sleeve and said positioning or locating element (15) at said auxiliary reference surface (18).

17. An electrical lamp having a light source (1) defining a lamp axis, including a light emitting element (2);

an optically alignable cementless base (4, 10, 15, 20) retaining said light source, said base including a metallic holder structure (4) coupled to the light source (1);

an at least part-metallic positioning or locating element (15) having an optical reference surface (17*a*) and a plane, flat auxiliary reference surface (18*b*);

a metallic tubular adjustment sleeve (10) surrounding the holder structure, at least in part, said holder structure being axially adjustable in said adjustment sleeve (10) to permit adjustment of said light source (1) with respect to said adjustment sleeve, and subsequent attachment, after adjustment, of the holder structure (4) to said sleeve (10), and wherein said tubular adjustment sleeve (10) comprises a sheet-metal element, which sheet-metal element is formed with a laterally projecting flange (14, 14*a*), said flange having a counter reference surface (14*b*) which is in surface contact with said plane, flat auxiliary reference surface (18*b*), said adjustment sleeve being positioned with said counter reference surface (14*b*) on said auxiliary reference (18*b*) to be rotatable and laterally shiftable with respect thereto to permit additional adjustment of said light source (1) with respect to the positioning or locating element (15) and its optical reference surface (17*a*);

wherein, after adjustment of the light source (1) with respect to the positioning or locating element (15), said tubular sheet-metal adjustment sleeve (10) and said positioning or locating element (15) are secured together by a metal-to-metal connection; and wherein said flange (14, 14*a*) has a plane, flat counter engagement surface (14*b*) fitting against said plane, flat auxiliary reference surface (18*b*).

18. The lamp of claim 17, wherein said positioning or locating element (15) comprises a tubular structure formed with a laterally projecting rim (17) on which said optical reference surface (17*a*) is formed, and said structure further includes a raised ring (18) located, with respect to the light source, above said projecting rim (17), the upper side of said ring (18) being formed with said auxiliary plane reference surface (18*b*) to located said auxiliary reference surface (18*b*) and said projecting rim (17) at different axial levels to facilitate making said metal-to-metal connection between the counter reference surface (14*b*) of the projecting flange (14, 14*a*) of said adjustment sleeve and said positioning or locating element (15) at said auxiliary reference surface (18).

19. The lamp of claim 17, including essentially axially extending cuts (13) formed in the tubular portion (12) of the adjustment sleeve (10) which has the reduced diameter to provide for resiliency of said portion.

20. The lamp of claim 17, wherein the flange (14) comprises a plurality of at least three circular segments (14*a*).

21. The lamp of claim 17, wherein said flange (14) comprises a complete circular flange region.

22. The lamp of claim 17, wherein said optical reference surface (17*a*) on the positioning and locating element (15) and the auxiliary reference surface (18*b*) thereon are at different axial levels.

23. The lamp of claim 18, wherein said adjustment sleeve (10) is formed with a tubular portion (12, 12') at the axial end facing said light source (1) which has a diameter reduced with respect to the diameter of the remainder (11*a*) of said adjustment sleeve.

24. The lamp of claim 23, wherein said laterally projecting flange (14, 14*a*) of the tubular adjustment sleeve (10) is formed with a counter reference surface (14*b*) which is in surface contact with said plane, flat auxiliary reference surface (18*b*).

* * * * *